US007712698B2

(12) United States Patent
Corrado et al.

(10) Patent No.: US 7,712,698 B2
(45) Date of Patent: May 11, 2010

(54) METHOD AND APPARATUS FOR FORMING A SHEETED ROLL OF MATERIAL

(75) Inventors: Frank C. Corrado, Rochester, NY (US); Gary R. Larsen, Webster, NY (US); Ronald W. Sweet, Conesus, NY (US); James W. Fischer, Rochester, NY (US)

(73) Assignee: Seratek, LLC, Rochester, NY (US)

( * ) Notice: Subject to any disclaimer, the term of this patent is extended or adjusted under 35 U.S.C. 154(b) by 298 days.

(21) Appl. No.: 11/977,758

(22) Filed: Oct. 26, 2007

(65) Prior Publication Data

US 2009/0108121 A1 Apr. 30, 2009

(51) Int. Cl.
*B65H 35/08* (2006.01)

(52) U.S. Cl. ..... 242/526.1; 242/525.4; 242/525.5

(58) Field of Classification Search ..... 242/525.1, 242/525.4–525.5, 526.1, 527.5
See application file for complete search history.

(56) References Cited

U.S. PATENT DOCUMENTS

| | | | | |
|---|---|---|---|---|
| 2,053,786 | A * | 9/1936 | Straubel | 242/524 |
| 4,695,006 | A * | 9/1987 | Pool | 242/525.2 |
| 5,335,869 | A * | 8/1994 | Yamaguchi et al. | 242/526 |
| 6,338,451 | B1 * | 1/2002 | Dorfel et al. | 242/527 |
| 2006/0057322 | A1 * | 3/2006 | Kennett et al. | 428/40.1 |

* cited by examiner

*Primary Examiner*—Sang Kim
(74) *Attorney, Agent, or Firm*—Woods Oviatt Gilman LLP

(57) ABSTRACT

An apparatus for forming a wound roll of discrete overlapping sheets of web from a supply of continuous web. The web preferably is passed around a nip roller that steers the web onto the surface of a take-up core. A knife assembly including a knife blade extended from a knife holder is driven by a traversing mechanism across the width of the web to cut the wound web on the core into discrete sheets, the extended height of the knife blade being preferably the exact thickness of the web. In transverse cutting by the knife of the web wound on the take-up core, the knife holder travels on the outer surface of the web, thus assuring that the knife blade extends just to the outer surface of the next inner convolution of web, thereby cutting the continuous web into sheets without damaging previously wound web convolutions.

15 Claims, 2 Drawing Sheets

METHOD AND APPARATUS FOR FORMING A SHEETED ROLL OF MATERIAL

TECHNICAL FIELD

The present invention relates to method and apparatus for forming a wound roll of material; more particularly, to method and apparatus for forming a wound roll of material comprising abutting discrete sheets of the material; and most particularly, to method and apparatus for forming such a roll wherein the sheets have an adhesive layer on at least one side thereof.

BACKGROUND OF THE INVENTION

Methods and apparatus are known for forming a roll of tape material, comprising individual sheets of material wound concentrically about a core, known in the art as a "sheeted roll". Typically, the sheets are all of the same length, so the degree of overlap of sheets decreases as the roll diameter increases during winding of the roll, and typically, the ends of adjacent sheets are abutting. Such rolls, when wound with an adhesive surface facing outwards from the core, are useful, for example, in cleaning particles from a substrate surface by transferring the particles to the adhesive surface when the roll is rolled along the substrate surface. In such use, the roll is known in the art as a "particle transfer roller" (PTR) or a "contact cleaning roller" (CCR). As each sheet becomes loaded with particles, it is peeled off and discarded, exposing a fresh sheet for continued cleaning.

US Patent Application Publication No. US 2006/0057322 A1, published Mar. 16, 2006 and now abandoned, discloses a method and apparatus for forming a sheeted roll from a continuous length of such material. Continuous material having an adhesive coating is passed around a cutting roller having a traversing knife which is disposed therewithin and is selectively retractable below the surface of the cutting roller. At designated intervals, the knife is extended and traverses the continuous material, cutting therefrom a length of material defining a sheet which is then removably applied to a sheeting roller. Successive sheets, when so cut and applied to a sheeting roller, which preferably includes an inert core, define a sheeted roll in accordance with the prior art and the present invention.

A problem arises in applying the disclosed prior art to practice. The apparatus shown in FIG. 4 thereof for forming the sheeted roll shows the sheeted roll 110 being distinctly off-spaced from cutting roller 312 by an unidentified gap. The specification is silent as to how the leading edge of an adhesive sheet, which is now severed from its predecessor and therefore is discontinuous, is to be transferred from the cutting roller to the sheeting roller. The present invention is directed to method and apparatus for reliably avoiding such a problem.

What is needed in the art is an improved means for forming a sheeted roll of material comprising overlapping sheets having adjacent abutting ends.

It is a principal object of the present invention to form a sheeted roll of material.

SUMMARY OF THE INVENTION

Briefly described, an apparatus in accordance with the invention for forming a wound roll of discrete overlapping sheets of web comprises optionally an unwinder for unwinding a supply roll of continuous flexible material, also referred to herein as a web, which may be adhesive on at least one side.

The web is passed around a nip roller that maintains tension in the web and steers the web onto the surface of a motorized take-up core for accumulating web into a wound roll. A knife assembly including at least one transverse knife blade extended from the surface of a knife holder is driveable by a traversing mechanism across the width of the web to cut the wound web on the core into discrete sheets, the extended height of the knife blade being preferably the exact thickness of the web. In transverse cutting by the knife of the web wound on the take-up core, the knife holder travels on the outer surface of the web, thus assuring that the knife blade extends just to the outer surface of the next inner convolution of web, thereby chopping the continuous web into sheets without damaging previously wound web convolutions. If square ends are desired on the sheets, the web and take-up core are stopped momentarily prior to traverse of the knife assembly. If diagonal ends are desired on the sheets, the web and take-up core continue movement of the web during traverse of the knife assembly. In a currently preferred embodiment, the knife blade is retracted into the knife holder during the reciprocal pass of the traversing mechanism across the now-cut web.

In a first alternative embodiment, the knife is double-edged and not necessarily retractable into the knife holder, and the knife cuts the web into discrete sheets in alternating reciprocal transverse directions.

In a second alternative embodiment, a plurality of knife blades is mounted and spaced apart along an endless belt driven transversely of the web, wherein the belt defines an alternative traversing mechanism. When one blade is traversed across the web to form a first cut, the second blade is caused to return in a path apart from the web in readiness for making the next desired cut.

BRIEF DESCRIPTION OF THE DRAWINGS

The present invention will now be described, by way of example, with reference to the accompanying drawings, in which.

DESCRIPTION OF THE PREFERRED EMBODIMENTS

Figures 1, 2:
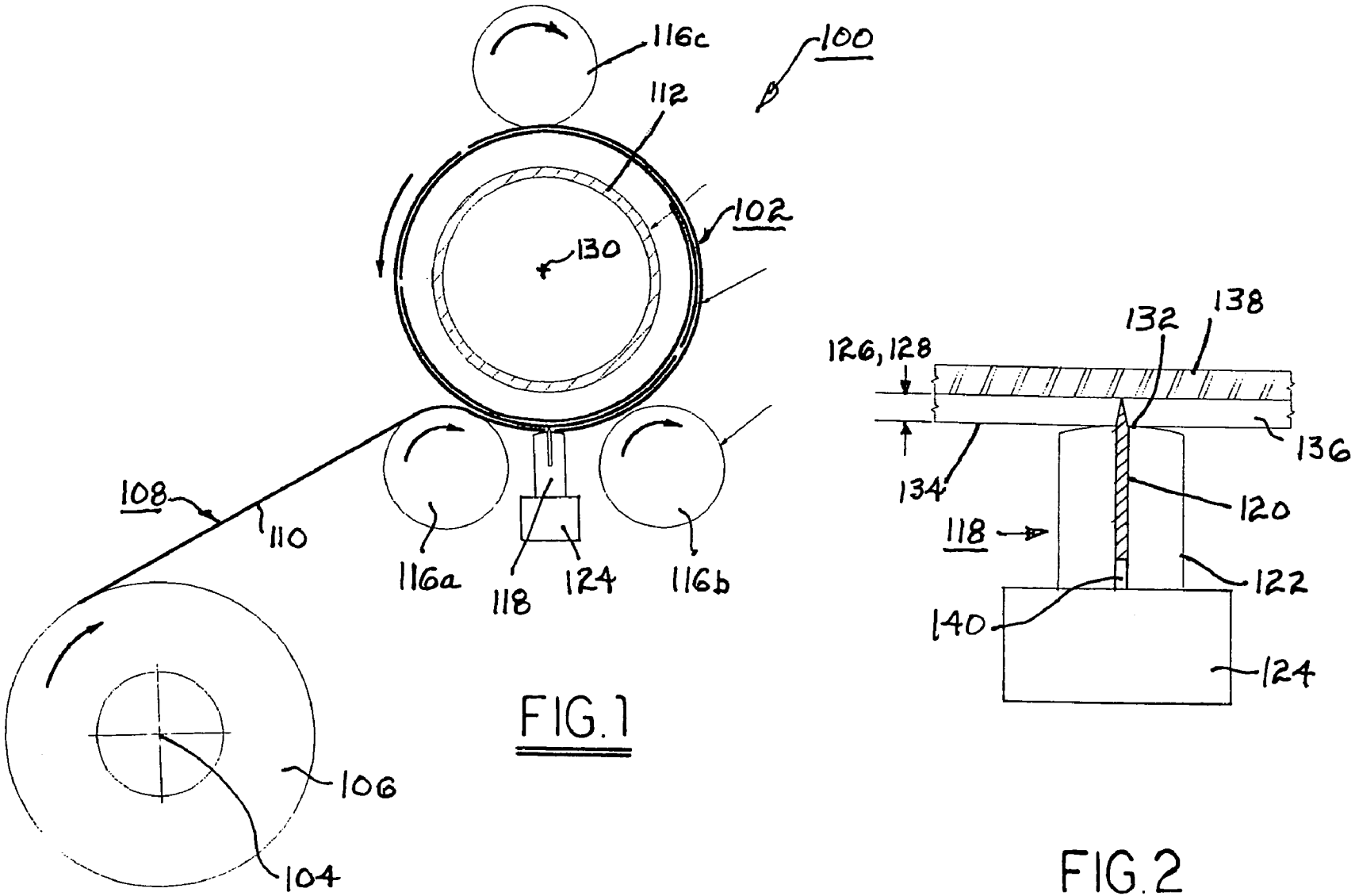
FIG. 1 is a schematic cross-sectional view of a generalized apparatus embodiment in accordance with the invention for forming a sheeted roll of material.
FIG. 2 is a schematic cross-sectional view of a portion of the embodiment shown in FIG. 1, showing a knife assembly and traversing mechanism for forming cut sheets on a tape-accumulating core.

Referring to FIGS. 1 and 2, a generalized embodiment 100 of an apparatus in accordance with the invention for forming a sheeted tape roll 102 comprises an optional unwinder 104 for unwinding a supply roll 106 of continuous flexible material 108, also referred to herein as a web, which may be adhesive 110 on at least one side. Web 108 is led onto a cylindrical core 112 for being wound thereupon in known fashion to form a wound roll of web. In embodiment 100, core 112 is engaged and captured by three nip rollers 116*a*,116*b*, 116*c*, at least one of which (preferably 116*a*) is driven in known fashion to cause web 108 to be unwound from supply roll 106 and wound onto core 112. Nip roller 116*c* is spring loaded (not shown) to allow for diameter growth in roll 102. In an alternative embodiment (not shown), nip rolls 116*b*, 116*c* may be eliminated and core 112 is mounted on a mandrel and center-driven in known fashion. In either embodiment, nip roll 116*a* preferably serves to guide web 108 onto the winding roll 102 and to provide excellent contact of web 108 with the preceeding convolution of web.

A knife assembly 118 comprises a knife blade 120 disposed in a knife holder 122 that is mounted on a linear traversing mechanism 124 such as a lead screw, as is well known in the mechanical arts, for traversing the knife assembly across the width of wound web on roll 102. The height 126 of extension of knife blade 120 is identical with the nominal thickness 128 of web 108, and traversing mechanism 124 is arranged parallel to the axis 130 of roll 102. Knife holder 122 is positioned on each traversing pass of knife assembly 118 such that upper surface 132 is indexed against the outer surface 134 of the last convolution 136 of web wound on roll 102. Thus, knife blade 120 cuts just through last convolution 136, but not into the immediately prior convolution 138, and severs the web to produce a discrete sheet on roll 102. Web 108 feeding onto roll 102 remains engaged therewith by virtue of nip roller 116*a*.

To produce a square end on the severed web, the driving of the driven nip roller is stopped before the knife assembly is traversed across the web. If a diagonal end is desired, the driven nip roller is not stopped but rather may be driven at any selected speed to produce a desired diagonal angle on the sheet end. The drive is then re-energized and additional web 108 is wound onto roll 102. When the correct length of additional web has been wound, the drive is again stopped, and the knife assembly is again traversed to produce another discrete sheet abutting the previous discrete sheet.

Knife blade 120 may be a single-edged knife that cuts in only one transverse direction, in which case knife blade 120 must be retracted from the path of web 108 on the return pass in preparing for the next cut. This may be done by retracting the traversing mechanism 124 radially from axis 130, or preferably by retracting knife blade 120 in slot 140.

Alternatively, knife blade 120 may be a double-edged knife (not shown) capable of cutting in both transverse directions, in which case the blade need not be retracted and sequential sheets are produced by alternate edges of the knife in alternating (reciprocal) transverse directions.

Figure 3:
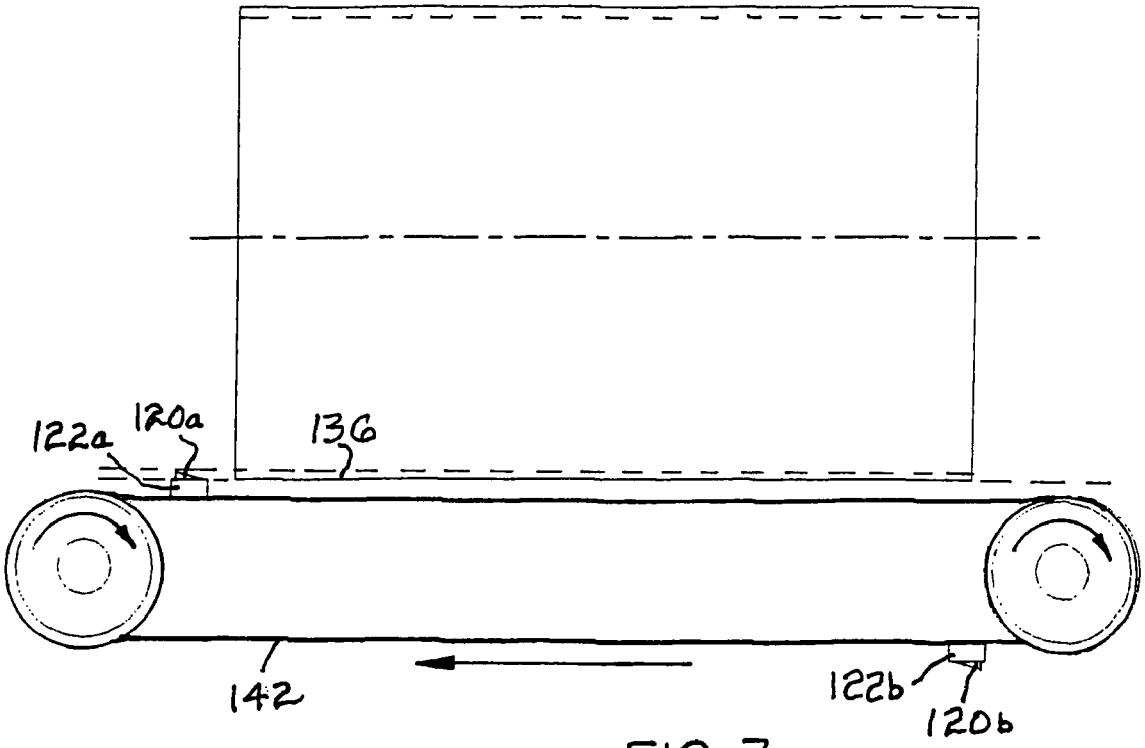
FIG. 3 is a schematic longitudinal view of an alternative tape-cutting mechanism in accordance with the invention.
Figure 4:
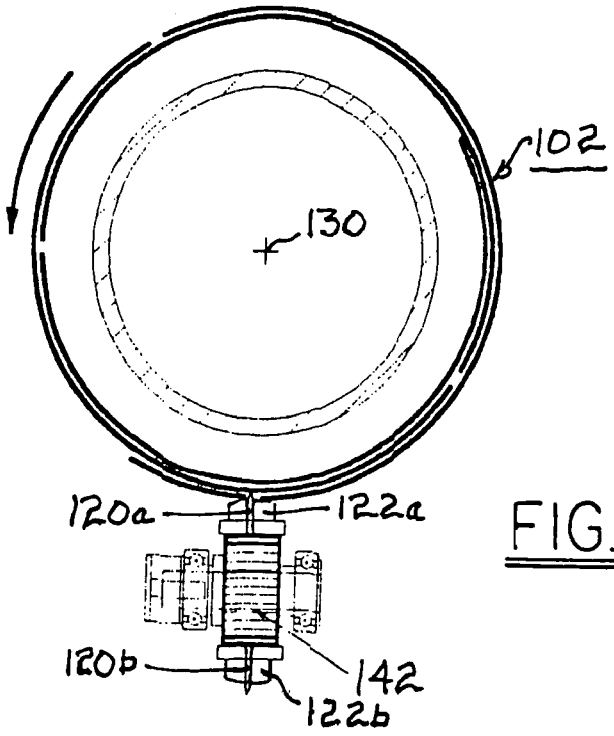
FIG. 4 is an end view of the alternative tape-cutting mechanism shown in FIG. 3.

Alternatively, and referring now to FIGS. 3 and 4, a plurality of knife blades 120 and optionally knife holders 122 may be mounted and spaced apart along an endless belt 142 driven transversely of the web, wherein the belt defines an alternative traversing mechanism. For example, two blades 120*a*,120*b* may be mounted 180° apart on belt 142 such that when one blade is traversed across the web to form a first cut, the second blade is caused to return in a path apart from the web in readiness for making the next desired cut. Each knife may be mounted in a separate knife holder 122*a*,122*b* mounted on the belt as desired, or the knives may be mounted directly in the belt and the belt itself may define a knife holder. To make a square ended cut, the belt and the web are advanced alternately such that the web is stopped while the belt is moving, and the belt is stopped while the web is moving.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for forming a roll of discrete overlapping sheets of material from a continuous length of the material, comprising:

a) a cylindrical core upon which said continuous length of material is wound, forming a wound roll, said wound roll defining successive convolutions of said continuous length of material;

b) a driving element for selectively rotating said core to wind said continuous length of material thereupon;

c) a traversing mechanism off-spaced from said core; and d) a knife blade mounted on said traversing mechanism for traversing across at least a portion of a width of said wound roll and extending toward said core, said knife blade and said traversing mechanism being configured such that during a traverse of said traversing mechanism said knife blade cuts through only an outer convolution of said successive convolutions of said continuous length of material to sever said outer convolution of said wound roll and to form said roll of discrete overlapping sheets.

2. The system in accordance with claim 1 further comprising a knife holder for holding said knife blade, wherein said knife blade is extendable from said knife holder by a length equal to the thickness of said outer convolution, and wherein during said traverse said knife holder rides on an outer surface of said outer convolution.

3. The system in accordance with claim 1 wherein said driving element is selected from the group consisting of a driven nip roller and a central core mandrel.

4. The system in accordance with claim 3 wherein said driving element is stopped during said traverse of said traversing mechanism.

5. The system in accordance with claim 3 wherein said driving element is operational during said traverse of said traversing mechanism.

6. The system in accordance with claim 1 wherein said knife blade is engaged with said outer convolution in only a first traversing direction.

7. The system in accordance with claim 6 wherein said knife blade is retractable from contact with said outer convolution during motion of said traversing mechanism in a reciprocal traversing direction.

8. The system in accordance with claim 1 wherein said knife blade is engaged with said outer convolution in both a first traversing direction and a reciprocal traversing direction.

9. The system in accordance with claim 8 wherein said outer convolution of said wound roll is severed in a first pass of said knife blade across said outer convolution of said wound roll in said first traversing direction at a first location, and said outer convolution of said wound roll is severed in a second pass across said outer convolution of said wound roll in said reciprocal traversing direction at a second location, wherein the length between said first and second severing locations defines the length of a discrete sheet.

10. The system in accordance with claim 1 wherein said traversing mechanism is selected from the group consisting of a reciprocating mechanism and an endless belt.

11. The system in accordance with claim 1 further comprising an unwinder mechanism for supplying said continuous length of material to said core.

12. The system in accordance with claim 1 wherein said continuous length of material includes adhesive on at least one side thereof.

13. The system in accordance with claim 1 wherein said wound roll is supported and captured by a plurality of nip rollers.

14. A method for forming a roll of discrete overlapping sheets of material from a continuous web of the material, comprising the steps of:

a) providing a cylindrical core;

b) winding a length of said continuous web of the material onto said cylindrical core;

c) cutting said wound continuous web of material transversely through an outer convolution thereof at a first location corresponding to the start of a one of said discrete sheets;

d) rotating said core to advance said continuous web of the material onto said core by a length equal to a desired length of a one of said discrete sheets defining a second location; and e) cutting said continuous web transversely through said outer convolution thereof at said second web location to form the end of a first one of said discrete sheets and the start of a second one of said discrete sheets.

15. The method in accordance with claim 14 comprising the further step of repeating steps d) and e) a number of times equal to a desired number of discrete sheets on said roll.

* * * * *